US009636835B2

(12) United States Patent
Buss

(10) Patent No.: US 9,636,835 B2
(45) Date of Patent: May 2, 2017

(54) PUSH/PULL ROTARY CUTTING APPARATUS DRIVEN BY SUBSTRATE

(71) Applicant: Richard S. Buss, Minnetrista, MN (US)

(72) Inventor: Richard S. Buss, Minnetrista, MN (US)

( * ) Notice: Subject to any disclaimer, the term of this patent is extended or adjusted under 35 U.S.C. 154(b) by 476 days.

(21) Appl. No.: 13/858,066

(22) Filed: Apr. 7, 2013

(65) Prior Publication Data

US 2013/0220094 A1 Aug. 29, 2013

Related U.S. Application Data

(63) Continuation of application No. 12/575,955, filed on Oct. 8, 2009, now abandoned.

(60) Provisional application No. 61/195,545, filed on Oct. 9, 2008.

(51) Int. Cl.

| | |
|---|---|
| ***B26D 5/38*** | (2006.01) |
| ***B26D 1/22*** | (2006.01) |
| *B26D 1/15* | (2006.01) |
| *B26D 5/20* | (2006.01) |

(52) U.S. Cl.

CPC ..... *B26D 5/38* (2013.01); *B26D 1/22* (2013.01); *B26D 1/15* (2013.01); *B26D 5/20* (2013.01); *Y10T 83/6584* (2015.04); *Y10T 83/6592* (2015.04); *Y10T 83/727* (2015.04); *Y10T 83/7793* (2015.04); *Y10T 83/872* (2015.04); *Y10T 83/8745* (2015.04)

(58) Field of Classification Search

CPC ... B26D 1/22; B26D 5/20; B26D 5/38; B26D 1/14; B26D 1/157; B26D 1/575; B26D 1/16; B26D 1/18; B26D 1/225; B26D 1/45; B26D 1/15; Y10T 83/6584; Y10T 83/8745; Y10T 83/872; Y10T 83/6592; Y10T 83/7793

USPC ..... 83/331, 332, 347, 505, 508.3, 498, 499, 83/504, 495, 561, 557

See application file for complete search history.

(56) References Cited

U.S. PATENT DOCUMENTS

| | | | | | |
|---|---|---|---|---|---|
| 235,163 | A | | 12/1880 | Marshall | |
| 1,510,656 | A | | 10/1924 | Clements | |
| 3,119,312 | A | * | 1/1964 | Henc | 83/333 |
| 3,274,874 | A | | 9/1966 | Treiber et al. | |
| 3,274,876 | A | * | 9/1966 | Debus | 83/415 |
| 3,296,911 | A | * | 1/1967 | McLane | 83/408 |
| 3,522,754 | A | | 8/1970 | Sauer | |
| 3,614,906 | A | * | 10/1971 | Hall | 3/505 |
| 3,677,122 | A | * | 7/1972 | Rautine | 83/506 |
| 3,685,379 | A | * | 8/1972 | Frye | B26D 1/245 83/482 |
| 3,771,398 | A | | 11/1973 | Schaefer et al. | |
| 3,823,633 | A | | 7/1974 | Ross | |
| 3,958,051 | A | * | 5/1976 | Smith | 428/42.3 |
| 3,982,455 | A | * | 9/1976 | Bowman | 83/105 |
| 4,003,276 | A | | 1/1977 | Schmitt | |

(Continued)

*Primary Examiner* — Jennifer Swinney

(57) ABSTRACT

An apparatus for cutting fiberglass insulation batting with a rotary blade where an elongate section of fiberglass insulation batting is manually pushed into an inlet of the apparatus whereupon the blade bites into the fiberglass insulation batting and whereupon the elongate now split section of fiberglass insulation batting begins to protrude from the outlet of the apparatus, whereupon the protruding sections of fiberglass insulation batting are manually grabbed and pulled through the apparatus further driving the rotary blade and further cutting the fiberglass insulation batting.

1 Claim, 8 Drawing Sheets

(56) References Cited

U.S. PATENT DOCUMENTS

| | | | | | |
|---|---|---|---|---|---|
| 4,031,600 | A | | 6/1977 | Whigham | |
| 4,289,055 | A | * | 9/1981 | Von Schriltz | 83/659 |
| 4,331,053 | A | * | 5/1982 | Imai | B23P 6/00 493/355 |
| 4,492,026 | A | | 1/1985 | Wiener et al. | |
| 4,759,247 | A | * | 7/1988 | Bell et al. | 83/346 |
| 5,001,950 | A | * | 3/1991 | Fokos et al. | 83/37 |
| 5,086,680 | A | | 2/1992 | Johnson | |
| 5,090,281 | A | * | 2/1992 | Paulson | B24B 3/368 83/13 |
| 5,214,852 | A | | 6/1993 | Napolitano | |
| 5,325,594 | A | | 7/1994 | Szafranski | |
| 5,372,494 | A | * | 12/1994 | Vaughan | B26D 7/2614 264/156 |
| 6,154,967 | A | | 12/2000 | Rogala | |
| 6,170,369 | B1 | | 1/2001 | Weinstein et al. | |
| 6,244,148 | B1 | * | 6/2001 | Vees | 83/348 |
| 6,837,135 | B2 | | 1/2005 | Michalski | |
| 7,303,799 | B2 | * | 12/2007 | Pereira | D04H 1/70 428/43 |
| 2001/0033782 | A1 | | 10/2001 | Conley | |
| 2010/0089214 | A1 | | 4/2010 | Buss | |
| 2012/0234145 | A1 | * | 9/2012 | Kandemir | 83/56 |

* cited by examiner

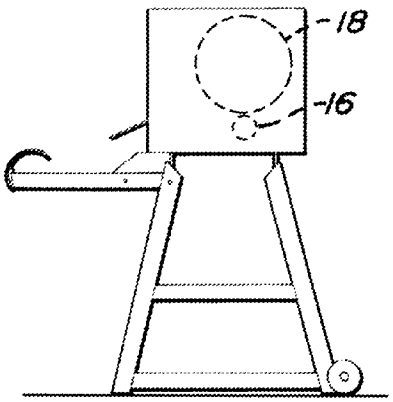
Fig. 6A
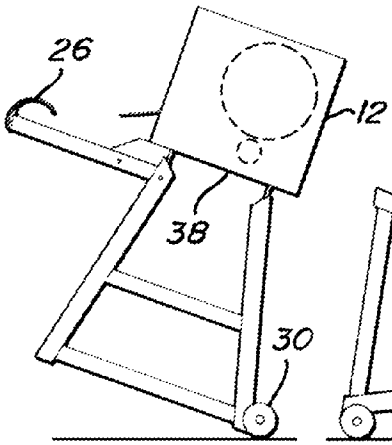
Fig. 6B
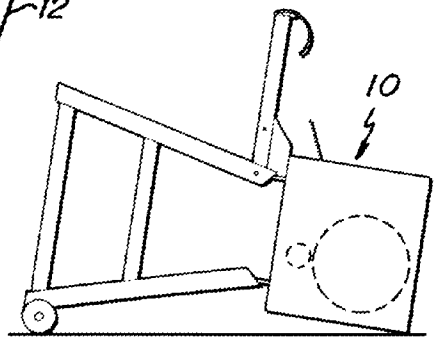
Fig. 6C
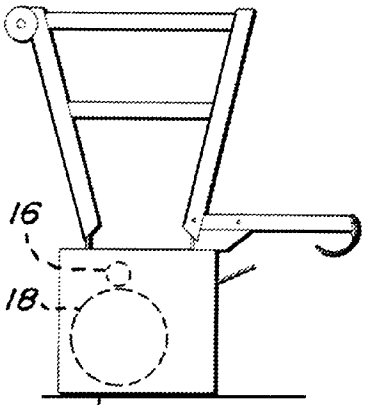
Fig. 6D
Fig. 6E
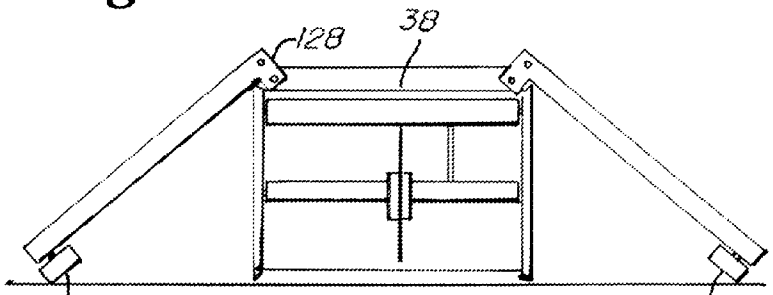
Fig. 6F
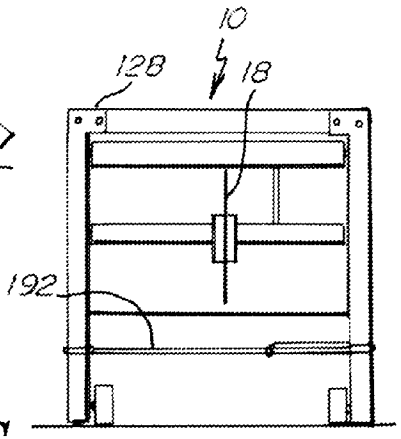
Fig. 6G

PUSH/PULL ROTARY CUTTING APPARATUS DRIVEN BY SUBSTRATE

This application is a continuation of U.S. patent application Ser. No. 12/575,955 filed Oct. 8, 2009 and claims the benefit thereof under 35 U.S.C. §120. U.S. patent application Ser. No. 12/575,955 filed Oct. 8, 2009 further claims the benefit under 35 U.S.C. §119(e) of U.S. Provisional Patent Application No. 61/195,545 filed on Oct. 9, 2008. U.S. patent application Ser. No. 12/575,955 filed Oct. 8, 2009 and U.S. Provisional Patent Application No. 61/195,545 filed Oct. 9, 2008 are hereby incorporated by reference in their entireties into this application.

FIELD OF THE INVENTION

The present invention generally relates to a rotary cutting apparatus, particularly to a rotary cutting apparatus that is driven by the substrate itself, and specifically to a rotary cutting apparatus that is driven by a fiberglass insulation batting substrate being pushed into and pulled out of the apparatus.

BACKGROUND OF THE INVENTION

Installation of fiberglass insulation is often part of numerous and varied building construction activities. For most purposes, such insulation is mass produced in long length and rolled up for transport and storage prior to use. Invariably, this type of insulation must be cut a desired length and/or width. For example, home construction and sheet metal applications usually require insulation cut along its length at a constant width. Material waste, code violations, and poor insulating qualities may result if the insulation is not cut properly.

Early concern over poorly-cut insulation fostered the use of several highly-mechanized cutting devices. Several, which have been used with some success, are characterized by rolling, cutter blades and automatic insulation feeders. A sharp blade with a narrowly tailored groove cuts fiberglass insulation as it is mechanically fed through the groove. Such devices cut insulation at a desired length and constant width, but are, for the most part, limited in use to factory or shop setting because of their large size and stationary nature.

Generally, these cutting devices are motorized and intricate in design. Once adjusted or calibrated, they work well in a situation where many pieces of insulation of constant length and width are required. High volume justifies a high price. However, for several pieces of fiberglass of a unique length and width, as are often needed at a construction site, the use of cutting devices of the prior art is substantially less than satisfactory, in terms of cost effectiveness and their considerable size. They are even less satisfactory for home use by the weekend warrior who does it himself or herself.

The search for an efficient, effective, and relatively low cost fiberglass insulation cutting device for use at the home or on the construction sites, meeting the requirements state above, has been an ongoing concern in the art. One approach, which is widespread but of limited success, is the use of a blade in conjunction with a straight edge cutting guide. Typically, a utility knife or another sharp portable blade is pulled through the insulation and guided by a straight edge laid loosely on the insulation surface.

One major problem is that these devices of the prior art rarely provide the desired cut. As is often the situation, the straight edge moves during use, usually by action of the utility knife against it. The result is a piece of fiberglass insulation not cut as measured and apt to provide poor insulation qualities. The inefficient use of material is obviously a short term problem. In the long term, higher heating bills continue to add to the economic cost.

Another significant problem is that the blades of the prior art tend to tear through the insulation. Repeated slices downward through the insulation rip or shred fibers. A side effect is that insulation fibers often become airborne and pose a respiratory hazard to any worker close by. Again, a shredded or ripped piece of insulation is also less likely to insulate as well as one cut evenly.

In summary, a considerable number of drawbacks and problems exist in the art relating to fiberglass insulation cutting devices. There is a need for a fiberglass insulation cutting apparatus usable at the home or construction sites, without the waste and without the respiratory hazard.

SUMMARY OF THE INVENTION

A feature of the present invention is the provision in a substrate driven rotary cutting apparatus, of the substrate being fiberglass insulation batting.

Another feature of the present invention is the provision in a substrate driven rotary cutting apparatus, of a housing having an inlet and outlet, with the substrate being pushed into the inlet manually, and with the substrate being pulled out of the outlet manually.

Another feature of the present invention is the provision in a substrate driven rotary cutting apparatus, of a rotary blade and anvil mounted in a housing, with a cutting edge of the rotary blade confronting the anvil at a location, with said substrate being fed into said location to cut said substrate, and with said substrate being fed into said location to pinch said substrate between said cutting edge and said anvil to thereby drive said rotary blade when said substrate is pulled out of the outlet manually.

Another feature of the present invention is the provision in a substrate driven rotary cutting apparatus, of the anvil including a resilient external surface that is engaged by the cutting edge of the rotary blade.

Another feature of the present invention is the provision in a substrate driven rotary cutting apparatus, of the anvil including a roller turning on an axis parallel to the axis of the rotary blade such that the anvil is a rolling anvil.

Another feature of the present invention is the provision in a substrate driven rotary cutting apparatus, of the rotary blade being adjustable in the axial direction to cut the substrate to different widths.

Another feature of the present invention is the provision in a substrate driven rotary cutting apparatus, of the resilient external surface laterally extending over the axial length that the rotary blade is adjustable.

Another feature of the present invention is the provision in a substrate driven rotary cutting apparatus, of the rotary blade and anvil being adjustable to and away from each other in a plane to adjust a confrontation of the cutting edge of the rotary blade with the anvil.

Another feature of the present invention is the provision in a substrate driven rotary cutting apparatus, of the housing including a top section, and of the top section having an opening extending in the axial direction of the rotary blade such that an axial position of the rotary blade is visible through the opening.

Another feature of the present invention is the provision in a substrate driven rotary cutting apparatus, of a fence engaged to the housing, of the fence extending at a right angle to the axis of the rotary blade, and of the fence being adjustable in the axial direction of the rotary blade such that the fence is adjustable to and away from the rotary blade.

Another feature of the present invention is the provision in a substrate driven rotary cutting apparatus, of a feed transitional member engaged to the housing, of the substrate sliding on an at least partially cylindrical surface of the feed transitional member such that the substrate makes a smooth transition from a position below the feed transitional member to the feed transitional member to the inlet.

Another feature of the present invention is the provision in a substrate driven rotary cutting apparatus, of a hand tool for pushing the substrate into the rotary blade, of the hand tool including a handle for manipulating the hand tool, of the hand tool being bifurcated so as to include a longitudinally extending slot between two longitudinal extensions, and of the longitudinally extending slot having a sufficient width to accept the thickness of the rotary blade therein.

Another feature of the present invention is the provision in a substrate driven rotary cutting apparatus, of first and second rollers and of the substrate being fed between the rollers, of a rotary blade engaged to the first roller and having a cutting edge, and of the second roller having a resilient external surface, and of the cutting edge biting into the resilient external surface when the rotary blade is turned by the substrate.

Another feature of the present invention is the provision in a substrate driven rotary cutting apparatus, of the apparatus having a housing, of the housing having a top and a bottom and a pair of handles, and of one of the handles being engaged to the top of the housing and with the other of the handles being engaged to the bottom of the housing such that the apparatus may be managed in an upright and operating configuration or in a folded down transportable configuration.

Another feature of the present invention is the provision in a substrate driven rotary cutting apparatus, of a pair of legs swingably engaged to a housing, of the pair of legs extending from a bottom portion of the housing and supporting the apparatus in an upright and operating configuration, of the pair of legs being swingable to extend to the opposite and top portion of the housing and supporting the apparatus in a folded down and transportable configuration, and of the legs including a pair of wheels that are operable in each of the configurations.

Another feature of the present invention is the provision in a substrate driven rotary cutting apparatus, of the apparatus being free of a motor or engine or external power source or electric power source or fuel powered power source.

Another feature of the present invention is the provision in a method for cutting a substrate, of the steps of providing a junction between a rotary blade and a rolling anvil, of pushing substrate into the junction, and of pulling the substrate out of the junction to drive the rotary blade and rolling anvil to cut the substrate.

An advantage of the present invention is an improved fiberglass insulation cutting apparatus that overcomes some of the problems and shortcomings of the prior art.

Another advantage of the present invention is an improved fiberglass cutting apparatus that is simplistic in design and available at relatively low cost.

Another advantage of the present invention is an improved fiberglass cutting apparatus that is portable, lightweight, durable, and useful at home or on construction sites.

Another advantage of the present invention is an improved fiberglass cutting apparatus such that fiberglass insulation may be cut to varying widths quickly, efficiently, and without waste of material at nonfactory settings.

Another advantage of the present invention is an improved fiberglass cutting apparatus that minimizes respiratory hazards associated with airborne fiberglass fibers.

BRIEF DESCRIPTION OF THE DRAWINGS

FIGS. 6A to 6G show diagrammatic views of the rotary cutting apparatus of FIG. 1 going through a step by step process that takes the rotary cutting apparatus of FIG. 1 from an upright and operating position to the wheelable compact configuration shown in FIG. 8, where FIG. 6A shows a side view of an upright and operating position, where FIG. 6B shows a side view of the rotary cutting apparatus in the process of being lowered from the upright and operating position to a laid down position, where FIG. 6C shows a side view of the laid down position, where FIG. 6D shows a side view of an upside down position, where FIG. 6E shows a front view of the upside down position, where FIG. 6F shows a front view of the legs of the apparatus folded down, and where FIG. 6G shows a front view of the rotary cutting apparatus in the wheelable compact configuration of FIG. 8.

DETAILED DESCRIPTION

Figure 1:
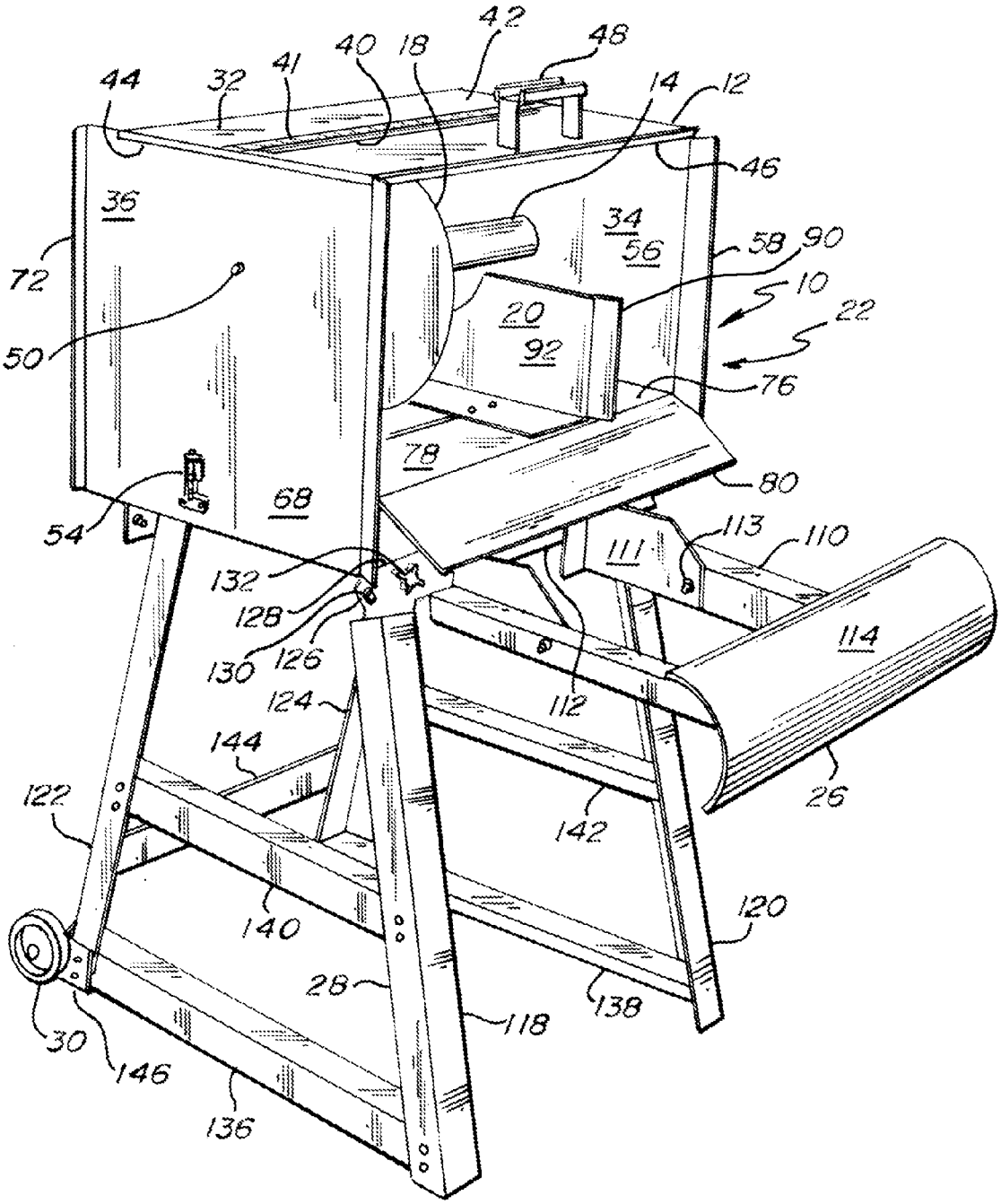
FIG. 1 is a front perspective view of the present substrate driven rotary cutting apparatus 10.
Figure 2A:
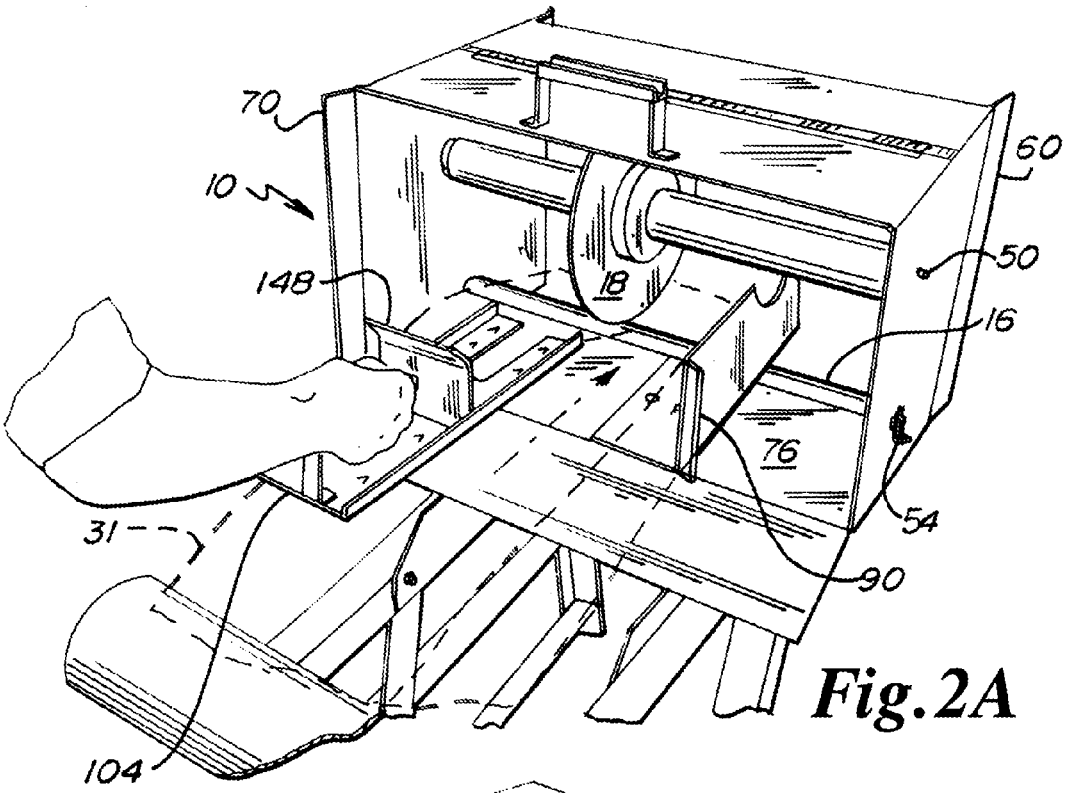
FIG. 2A is a perspective partial view of the front of the rotary cutting apparatus of FIG. 1 and shows a slotted hand tool for pushing substrate into a location where the rotary blade meets a rolling anvil.
Figure 2B:
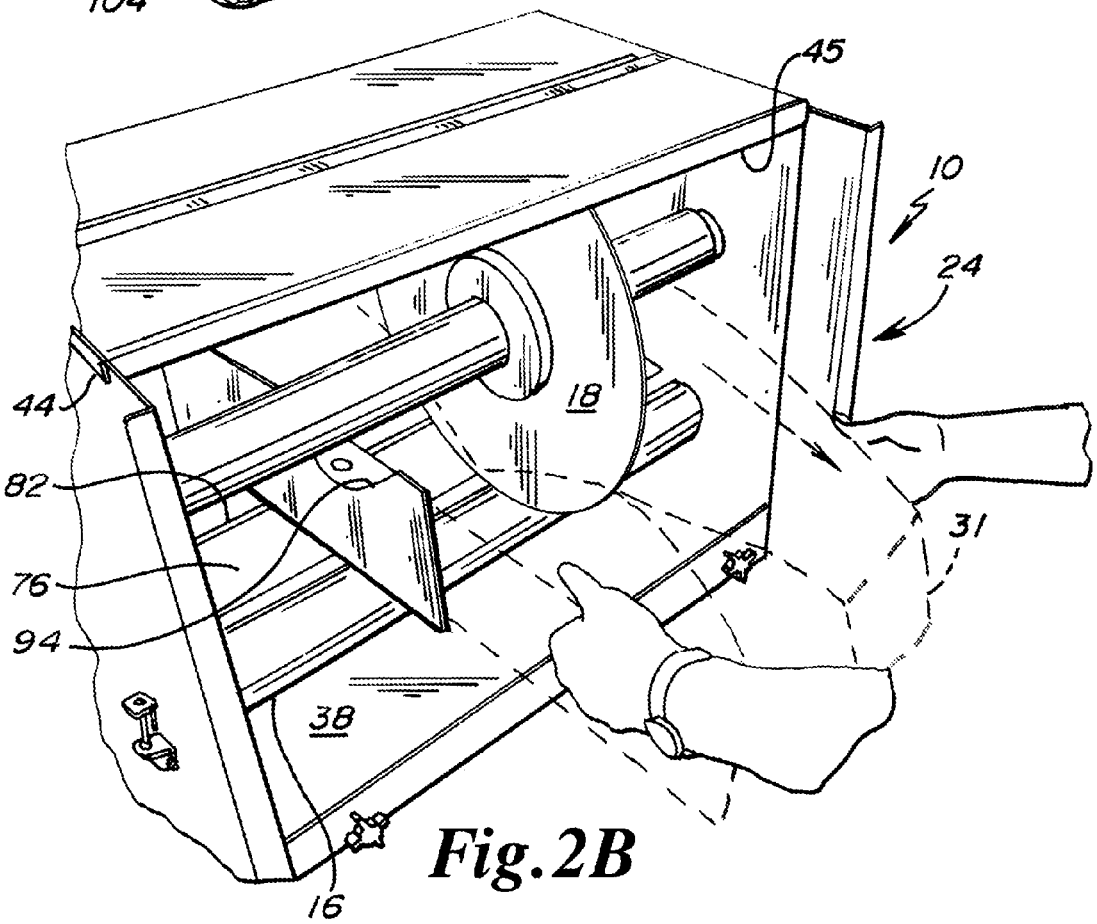
FIG. 2B is a perspective partial view of the rear of the rotary cutting apparatus of FIG. 1 and shows a user pulling cut substrate out of the apparatus and simultaneously driving the rotary blade.

As shown in FIGS. 1, 2A and 2B, the present rotary cutting apparatus is designated by reference numeral 10.

Rotary cutting apparatus 10 generally includes a housing 12, an upper first roller 14 engaged to the housing 12, a lower second roller 16 engaged to the housing 12, a rotary or circular blade 18 engaged to the first roller 14 and engaging the second roller or rolling anvil 16, a fence 20 engaged to the housing 12 and being adjustable to and away from the rotary blade 18, an inlet 22, an outlet 24, a feed transition member 26 engaged to the housing 12, legs 28 supporting the housing 12, and a pair of wheels 30. The preferred substrate 31 for the rotary cutting apparatus 10 is fiberglass insulation batting, shown in FIGS. 2A, 2B and 4D.

Housing or frame 12 is a box or box like structure having a horizontally extending top 32, vertically extending first side 34, vertically extending second side 36, and horizontally extending bottom 38. Housing 12 further includes the inlet 22 or front open end 22 formed by front portions of the top 32, sides 34, 36 and bottom 38. Housing 12 further includes the outlet 24 or rear open end 24 formed by rear portions of the top 32, sides 34, 36 and bottom 38. Top 32, sides 34, 36, and bottom 38 are panels and may be formed of sheet metal. Main body panels of top 32 and bottom 38 lie parallel to each other. Main body panels of each of top 32 and bottom 38 lay at a right angle to each of sides 34, 36. Main body panels of sides 34, 36 lie parallel to each other. Housing 12 keeps hands, fingers, and other objects away from the rotary blade 18 and serves as a frame or mount for rollers 14, 16, rotary blade 18 and feed transition member 26.

Top 32 includes therein a laterally extending slot 40 that is parallel to an axis of the first roller 14 and that lies in a vertical plane that cuts through a portion of the rotary blade 18 such that the rotary blade 18 is visible when looking down through the slot 40. Measuring indicia employing one or both of the English and metric systems, such as a measuring tape 41, may be engaged parallel to slot 41 and extend from side 34 to side 36. One end of slot 40 confronts and is spaced from side 34 and the other end of slot 40 confronts and is spaced from side 36. A body 42 of top 32 lies in a plane. Side edge portions 44 of top 32 extend longitudinally and are bent downwardly at right angles to confront sides 34, 36. A rear edge portion 45 extends laterally and is bent downwardly at a right angle. A front edge portion 46 extends laterally and is bent obliquely upwardly to function as a guide for substrate 31 being fed into the inlet 24. A handle 48 is engaged to top 32 at a location that confronts the front edge portion 46. The grip of the handle 48 extends in the lateral direction.

Side 34 includes an opening formed therein for mounting one end of an axle 50 for upper roller 14. Side 34 includes a vertically extending slot 51, shown in FIG. 5A, formed therein for mounting an axle 52 for lower roller 16. Confronting and partially covering slot 51 is an over center toggle clamp 54, which is engaged to side 34. Side 34 includes a main body 56. A front edge portion 58 of side 34 extends vertically and further extends obliquely outwardly to act as a guide for substrate 31. A rear edge portion 60 of side panel 34 extends vertically and further extends outwardly at a right angle to minimize interference with substrate 31 exiting the outlet 24.

Side 36 includes an opening formed therein for mounting the other end of axle 50 for upper roller 14. Side 36 includes vertically extending slot 51, which is formed therein for mounting axle 52 for lower roller 16. Confronting and partially covering slot 51 is over center toggle clamp 54, which is engaged to side 36. Side 36 includes a main body panel portion 68. A front edge portion 70 of side 36 extends vertically and further extends obliquely outwardly to act as a guide for substrate 31. A rear edge portion 72 of side panel 34 extends vertically and further extends outwardly at a right angle to minimize interference with substrate 31 exiting the outlet 24. Side 36, or specifically main body panel portion 68, acts as a guide for one side of the substrate 31 and opposes the fence 20, which guides the other side of the substrate 31.

Figure 7:
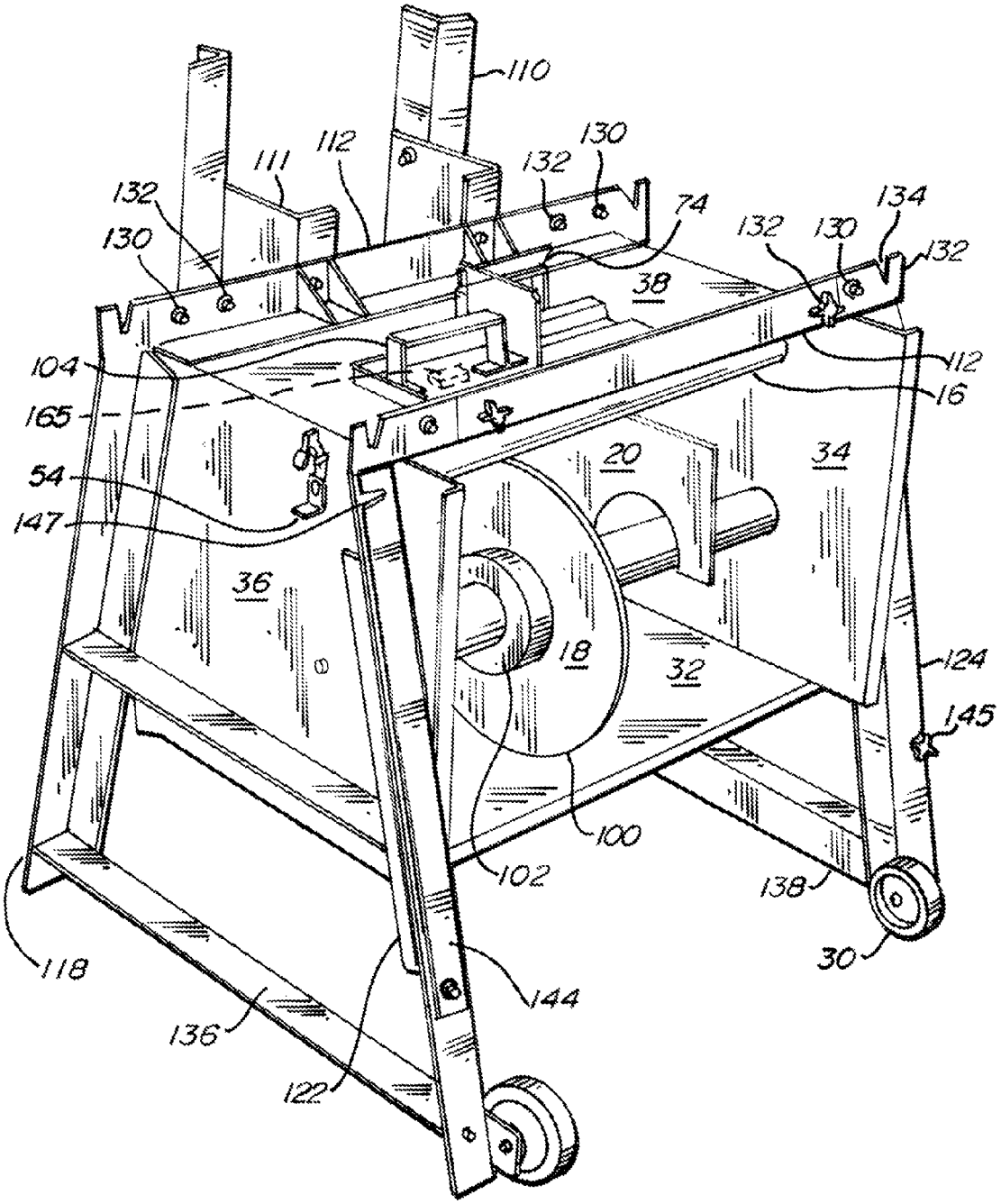
FIG. 7 shows a rear perspective view of the rotary cutting apparatus of FIG. 1 where the apparatus has attained the compact wheelable configuration of FIG. 8 except that the configuration of FIG. 7 shows the feed transition member folded down.

Bottom 38 runs from side 34 to side 36 and is integral and one-piece with sides 34, 36. Side 34 runs into bottom 38 that runs into side 36. Side 34, bottom 38 and side 36 are formed from one sheet of material, such as sheet metal, which is bent at the juncture of side 34 and bottom 38 and at the juncture of side 36 and bottom 38. Bottom 38 provides a support for engaging legs 28. A handle 74, shown in FIG. 7, is engaged to the bottom 38 between the front and rear edges of the bottom 38 and generally equidistance from the front and rear edges of the bottom 38. Handle 74 includes a grip that extends laterally. After legs 28 have been folded for operation in the wheelbarrow configuration of FIGS. 7 and 8, apparatus 10 may be hand carried or otherwise manipulated by handle 74.

Housing 12 further includes a feed table 76. A main body portion 78 of the feed table 76 is engaged to and between sides 34, 36 and extends laterally and horizontally between the sides 34, 36. Feed table 76 is disposed between top 32 and bottom 38 and the main body panel of portion of feed table 76 runs parallel to the main body portions of top 32 and bottom 38. Feed table 76 includes a ramp portion 80 that extends forwardly, downwardly and obliquely relative to the main body portion 78. Ramp portion 80 guides substrate 31 into the inlet 22. Main body portion 78 includes a laterally extending slot 82 therein. One end of slot 82 confronts and is spaced from side 34. The other end of slot 82 confronts and is spaced from side 36. Slot 82 receives a pin 84 that engages guide or fence 20. Guide or fence 20 includes a horizontally and longitudinally extending floor portion 86 that engages pin 84 and a vertically and longitudinally extending wall portion 88 that confronts and guides a side of substrate 31. Floor portion 86 extends longitudinally between a) the rear edge of ramp portion 80 and b) lower roller or rolling anvil 16. The rear edge of floor portion 86 confronts and is spaced from the front vertical tangent of rolling anvil 16. Wall portion 88 includes two sections, a front section 90 and a main body section 92, with the main body section 92 including a cutout 94. A front section 90 extends forwardly of the rear edge of ramp portion 80. Front section 90 further extends obliquely outwardly so as to guide substrate 31 into the inlet 22. Main body section 92 extends vertically from floor portion 86 and includes upper rectilinear edges that terminate at an elevation intermediate the top and bottom edges (or horizontal tangents) of upper first roller 14. Cutout 94 is formed between the rectilinear upper edges of main body section 92. The edge of main body section 92 that forms cutout 94 confronts and is spaced from the cylindrical external surface of upper first roller 14. Main body section 92 further extends longitudinally from the rear edge of section 90 or rear edge of ramp portion 80 to a location that confronts or is in a plane with the rear edges or edge portions of top 32 and bottom 38.

Pin 84 is a tensioned pin. As shown in FIG. 5C, pin 84 includes a head 94.1, a lock nut 94.2, and a shaft 94.3 between the head 94.1 and the lock nut 94.2. Lock nut 94.2 is anchored at the distal end of shaft 94.3. An upper washer 94.4 rides on the shaft 94.3 and confronts and makes contact with the underside of the main body 78 of fence 20. A lower washer 94.5 confronts and makes contact with lock nut 94.2. Biasing the upper washer 94.4 apart from the lower washer 94.5 is a coil spring 94.6 that rides on shaft 94.3. Fence 20 slides laterally in a direction from side 34 to side 36 or in a direction from side 36 to side 34 to orient panel 92 at the desired width. This sliding is a tensioned sliding regulated by the pinching action between head 94.1 and upper washer 94.4, where upper washer 94.4 is biased in the upward direction by coil spring 94.6, which is anchored by lower washer 94.5. This pinching action is sufficiently tight to minimize sliding of fence 20 such as when substrate 31 slides against the fence 20 in the longitudinal direction. This pinching action is sufficiently loose such that the hand of the user can push the fence 20 laterally to the desired position without loosening lock nut 94.2. This pinching action can be described as a friction fit.

Housing 12 further includes upper first roller 14. Roller 14 is mounted on bearings such as roller bearings to axle 50, which engages sides 34, 36. Roller 14 extends in the lateral or transverse direction. The axis of roller 14 is intermediate the main body 78 of the feed table 76 and the top 32. Roller 14 mounts a nonmetallic (such as nylon or plastic) hub 102 to which circular blade 18 is fixedly engaged. Hub 102 includes two half portions, between which is sandwiched circular blade 18. Pins run through the hub half portions and circular blade 18 to engage the half portions on either side of the circular blade 18. Hub 102 and blade 18 are slideable under hand pressure in the lateral direction along the external surface of roller 14. Hub 102 and blade 18 are also rotatable relative to the roller 14. However, resistance to rotation of the hub 102 and blade 18 relative to the roller 14 is greater than the resistance to rotation of the roller 14 relative to the axle 50 such that blade 18 and hub 102 normally rotate with the roller 14. The external surface of roller 14 is metal, such as steel. Roller 14 is relatively massive to provide a relatively great amount of torque to the cutting edge 100 of blade 18. A relatively large portion of roller 14 may be formed of metal to provide the relatively great amount of mass to the roller 14. Hub 102 is sized, or a central opening of hub 102 is sized, to slide back and forth in the lateral direction on upper first roller 14 with a slight but positive resistance. The outer diameter of the blade 18 is greater than the outer diameter of the hub 102. The outer diameter of the hub 102 is greater than the outer diameter of the upper first roller 14.

Blade 18 is a circular blade having a circular cutting edge 100. Blade 18 is formed of stainless steel. Blade 18 is held perpendicular and true to the axis of upper first roller 14 by the hub 102, which is machined and nonmetallic. A user pushes substrate 31 between the cutting edge 100 and rolling anvil 16 by employing hand tool 104. As the substrate 31 is pushed between the cutting edge 100 and rolling anvil 16, the substrate 31 is compressed, pinched and cut between the cutting edge 100 and the rolling anvil 16. Then the user walks to the rear of the apparatus 10 and pulls the substrate 31 through the apparatus 10. This pulling action continues the compression, pinching and cutting action. The pinching and pulling action is the force that drives the circular blade 18 to continue the compression, pinching and cutting actions.

Housing 12 further includes lower second roller 16. Roller 16 is mounted to and between sides 34, 36 via axle 54. Roller 16 is mounted on axle 54 via bearings such as roller bearings. Roller 16 extends in the lateral or transverse direction. As shown in FIG. 4C, roller 16 includes a covering 108 as its outermost or external surface. Cutting edge 100 impinges upon or engages covering 108. Covering 108 is formed of a resilient material such as a rubber or elastomeric material. Cutting edge 100 may compress resilient covering 108 to a depth, shown by the dashed line 109. Depending on the hardness of the resilient covering 108, depending upon the sharpness of the cutting edge 100, depending upon the hardness of the substrate 31, where fiberglass is a relatively hard substrate 31, covering 108 may or may not be penetrated and may or may not itself be cut.

Blade 18 and thus cutting edge 100 are slideable in the lateral direction on roller 14 over the axial distance of the roller 14 to each of the ends of the roller 14, limited only by the width of the half-section of the hub 102 found on each side of the blade 18. Sliding of blade 18 and hub 102 comes to a stop when hub half-sections hit the housing sides 34, 36. Blade 18 and cutting edge 100 are slideable laterally such that blade 18 and cutting edge 100 can confront each of the sides 34, 36 of the housing 12. Roller or rolling anvil 16 and the resilient external surface 108 extend in the lateral direction to opposite ends of the roller 16. Each of the ends of the roller 16 confronts one of the sides 34, 36 of the housing 12. Accordingly, cutting edge 100 can engage the resilient external surface 108 over a large axial distance, with the distance being from a location that confronts side 34 of housing 12 to a location that confronts the side 36 of housing 12.

The axis of lower second roller 16 is drawable to and away from the axis of upper first roller 14 via slots 51 and over center toggle clamps 54. The axis of rollers 14, 16 lie in a vertical plane. Over center toggle clamps 54 permit a quick release or drop down of each end of the axle 52 of the lower second roller 16, an action that permits the lateral adjustment of hub 102 and blade 18, where otherwise the engagement between cutting edge 100 and rolling anvil 16 prevents the lateral adjustment of hub 102 and blade 18.

The over center toggle clamp 54 includes a micro adjustment that permits a lowering or raising of the axis of the lower second roller 16 to a fine degree, such as one-thousandth of an inch. Such an adjustment, to the one-thousandth of an inch, provides for proper impingement of the cutting edge 100 on the covering 108 and further provides for proper compression of the covering 108. The upper edge of the lower second roller 16 is preferably disposed in the plane or confronts the plane of the upper surface of the main body 78 of the feeding table 76.

Apparatus 10 includes the feed transitional member 26. Feed transitional member 26 is fixedly engaged to a pair of forwardly extending horizontal support members or arms 110. Horizontal support members 110 are swingably engaged via pins 113 to angle irons 111, which in turn are fixedly engaged to a laterally extending angle iron support member 112, which in turn is fixedly engaged to bottom 38 of housing 12. Laterally extending angle iron support member 112 runs along a front edge portion of bottom 38 and runs laterally the full length of bottom 38 so as to terminate at sides 34, 36.

Feed transitional member 26 includes an outer surface 114 that is cylindrical. Namely, outer surface 114 forms generally a one-half cylinder. Feed transitional member 26 is disposed in the lateral direction. An upper edge 116 of the surface 114 runs horizontally and laterally and is disposed at a level that is slightly below the level of the lower edge of ramp portion 80. Upper edge 116 is where a horizontal tangent intersects surface 114. Substrate 31, such as elongate fiberglass insulation batting, runs from the ground or surface upon which the legs 28 rest, up to the outer surface 114, and then into the inlet 22. The feed transitional member 26 is spaced forwardly of the inlet 22 in the longitudinal direction. Surface 114 of feed transitional member 26 extends parallel to the axial directions of the first and second rollers 14, 16.

Surface 114 includes a forwardmost and uppermost edge 115, where a vertical tangent intersects surface 114, such that substrate 31 makes a smooth transition from a position below the feed transitional member 26 to the feed transitional member 26 and then to the inlet 22.

Legs 28 include front legs 118, 120 and rear legs 122, 124. Each of the legs 118, 120, 122 and 124 includes a proximal end 126. Proximal end 126 is in the shape of a dog leg so as to include an extension 128 that extends inwardly when the apparatus 10 is in the upright and operating configuration shown in FIG. 1. Extension 128 is swingably engaged to angle iron lateral support member 112 via a pin 130. Extension 128 is releasably engaged to angle iron lateral support member 112 via a pinch or clamping pin 132. Extension 128 includes therein a V-shaped cutout 134 that receives a threaded pin of the clamping pin 132. When the pin of clamping pin 132 is in the V-shaped cutout, then the clamp of the clamping pin 132 can be turned on the threaded pin to pinch extension 128 between the inner end of the clamp and the outer surface of the lateral support member 112 to fix the proximal end 126 and its respective leg 118, 120, 122, or 124 in the upright position. Proximal end 126 can be swung, and thus the respective leg 118, 120, 122, or 124 can be swung by loosening the clamp of the clamping pin 132.

A lower brace 136 is engaged to and between distal end portions of legs 118, 122. A lower brace 138 is engaged to and between distal end portions of legs 120, 124. An intermediate brace 140 is engaged between legs 118, 122 at a location between the proximal and distal ends of legs 118, 122. An intermediate brace 142 is engaged between legs 120, 124 at a location between the proximal and distal ends of legs 120, 124. A swingable rear brace 144 is engaged between rear legs 122, 124. One end of rear brace 144 is swingably engaged to leg 122 at a location between braces 136 and 140. The other end of rear brace 144 is engaged to leg 124 at a location between braces 138 and 142 where a clamp pin 145, shown in FIG. 7, is turnable into and out of the face of the leg 124. The pin of the clamp pin 145 is received in a V-shaped cutout 147 formed in an end of brace 144, and then the clamp of the clamp pin 145 is screwed down to pinch the end of the brace 144 to the face of the leg 124. Clamp pin 145 and V-shaped cutout 147 operate in the same manner as clamp pins 132 and V-shaped cutouts 134 operate. Legs 118, 120, 122 and 124 are angle iron members. Braces 136, 138, 140, 142 and 144 are angle iron members.

Each of the wheels 30 is engaged to a foot 146 which in turn is engaged to a distal end of a respective rear leg 122, 124. Foot 146 is rigid relative to its respective leg 122, 124 such that apparatus 10 may be tipped back to rest on the ground or surface via the wheels 30 only such that apparatus 10 may be wheeled from location to location. Distal ends of legs 118, 120, 122 and 124 terminate in a plane. The circumference of each of the wheels 30 confronts and is spaced from the plane such that, when the apparatus 10 is in the upright and operating position, the friction between the distal ends of legs 118, 120, 122, and 124 and the surface on which the apparatus 10 rests overcomes the pulling force of a user pulling on the substrate 31 to cut the substrate 31. Foot 146 maintains the circumference of wheel 30 above such plane and in a confronting relationship with such plane such that apparatus 10 can be tipped back, such as shown in FIG. 6B, such that wheel 30 engages the surface.

Figure 4A:
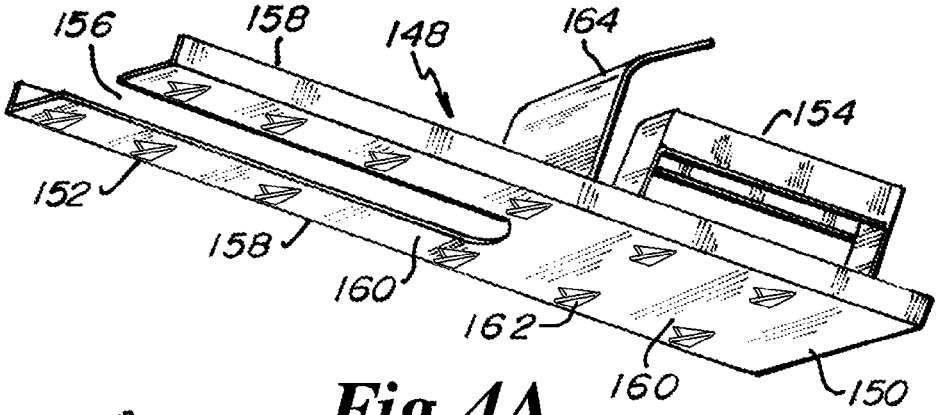
FIG. 4A is a bottom perspective detail view of the slotted hand tool of FIG. 2A.
Figure 4B:
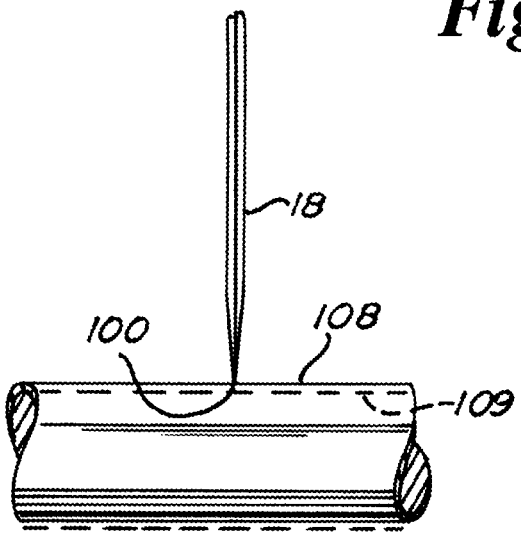
FIG. 4B is a front detail view of portions of the rotary blade and rolling anvil of FIG. 3 and shows the engagement or bite between the cutting edge of the rotary blade and the rolling anvil.
Figure 4C:
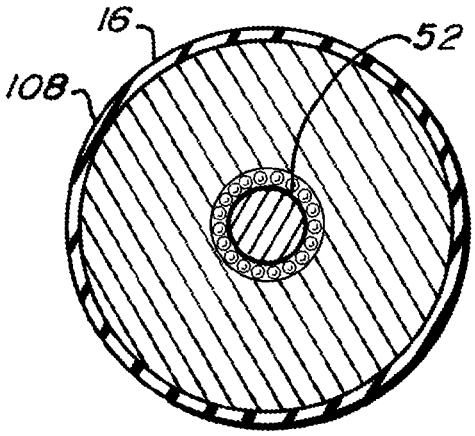
FIG. 4C is a section detail view of the rolling anvil of FIG. 3.

As shown in FIGS. 2A and 4A, substrate 31 is pushed into the junction between the cutting edge 100 and the rolling anvil 16 by a hand tool or pusher plate 148. The hand tool 148 includes a proximal end portion 150 and a distal end portion 152. The proximal end portion 148 includes a handle 154 for manipulating the hand tool 148. Distal end portion 152 is bifurcated so as to include a longitudinally extending slot 156 between two longitudinal extensions 158. Longitudinally extending slot 156 has a sufficient width to accept the thickness of the rotary blade 18 therein. Hand tool 148 includes a lower surface 160 disposed opposite of the handle 154. Lower surface 160 is roughened to catch the substrate 31 such that the top surface portion of the substrate 31 can be engaged and then pushed into the junction between the cutting edge 100 and the rolling anvil 16. One way to roughen the lower surface 160 is to punch triangular openings or V-shaped openings in a metal plate that forms the base of the hand tool 148. The result of such a punching is a V-shaped prong or catch 162 that remains integral and one-piece with the metal plate and includes a point or peak extending downwardly and in the longitudinal direction toward the distal end portion 152. Hand tool 148 further includes a shield 164 between the proximal and distal end portions 150, 152. Shield 164 confronts the handle 154 and curves at least partially over at least a portion of handle 154. Shield 164 extends laterally to protect a hand on the handle 154 from the rotary blade 18. Hand tool 104 may be stored on the underside of the bottom 38 by the use of a magnet 165, shown in FIG. 7.

Figure 5A:
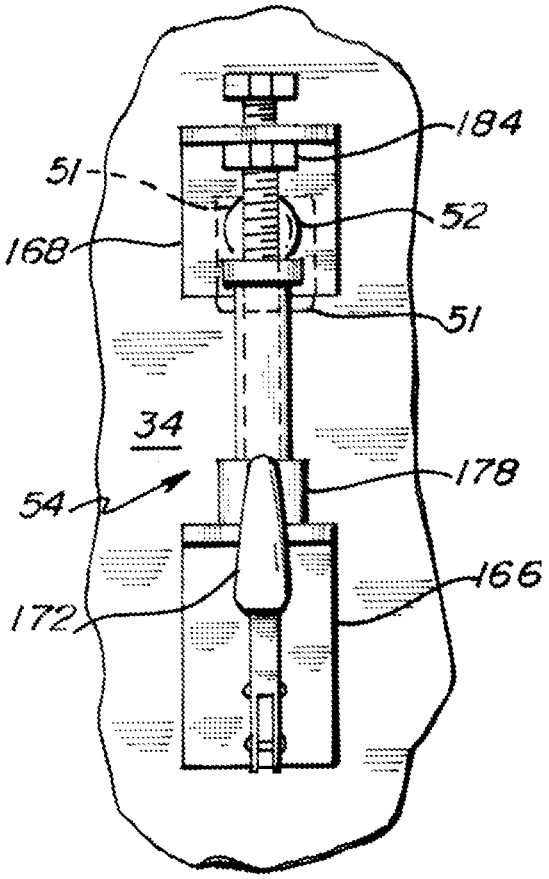
FIG. 5A is a front detail view of the over center toggle clamp mounted on the housing of FIG. 1 to draw the rolling anvil to and away from the cutting edge of the rotary blade.
Figure 5B:
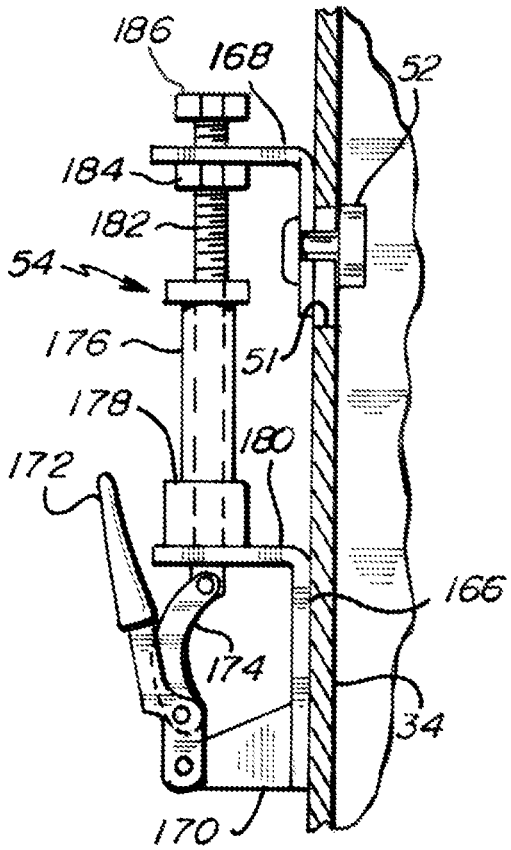
FIG. 5B is a side detail view of the over center toggle clamp of FIG. 5A.
Figure 5C:
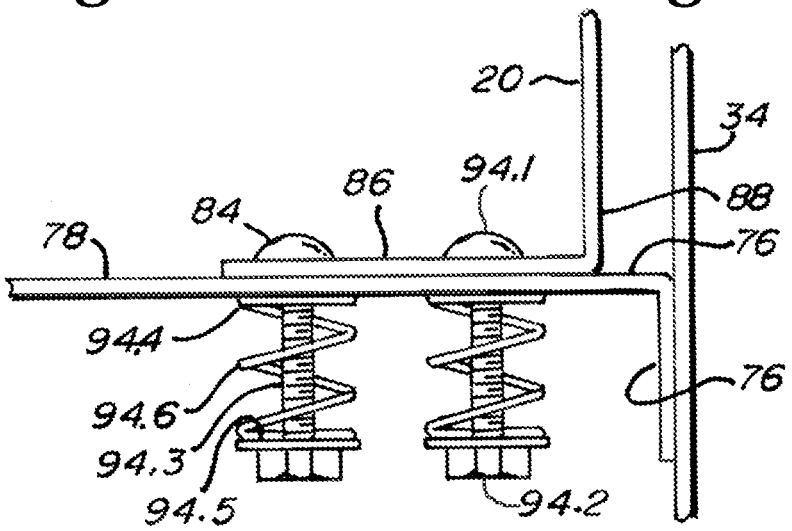
FIG. 5C is a front detail view of the tensioned arrangement between the fence and the feed tray of FIG. 1.

As shown in FIGS. 5A and 5B, over center toggle clamp 54 includes a stationary base 166 and a movable base 168. Stationary base 166 is fixedly engaged to side 34 or 36 of housing 12. Movable base 168 engages axle 52 of the rolling anvil 16. Stationary base 166 includes an extension 170 to which a first arm 172 is swingably engaged. First arm 172 is in turn swingably engaged to a second arm 174. Second arm 174 is a curved or bent arm. Second arm 174 in turn is swingably engaged to a shaft 176 that is interiorly threaded. Shaft 176 rides in a bushing 178 that is rigidly affixed to an extension 180 of the stationary base 166. A threaded pin 182 is received in shaft 176 and extends through an opening in the angle iron shaped movable base 168. A first nut 184, such as a locking nut, serves as a platform for movable base 168 and the height of nut 184 regulates the height of the rolling anvil 16, which regulates the resilient engagement between the cutting edge 100 and the rolling anvil 16. Nut 184 may be adjusted to one-thousandths of an inch so as to finely tune the engagement between the cutting edge 100 and the rolling anvil 16. A second nut 186 may be screwed down to pinch the movable base 168 to the first nut 184 to further stabilize the rolling anvil 16. Arms 172 and 174 provide an over center action such that movable base 168 and axle 52 may be quickly released and dropped or quickly raised and clamped to an engaged position (where rolling anvil 16 engages cutting edge 100) on the order of about one-quarter inch, or one-half inch, or even one inch, depending upon the size of toggle clamp 54 installed.

Figure 4D:
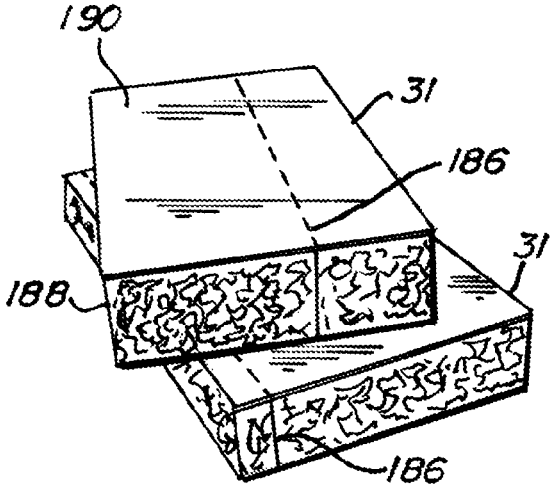
FIG. 4D is a perspective view of cut substrate of FIGS. 2A, 2B and 3 where the substrate is fiberglass insulation batting.

FIG. 4D shows the substrate 31 that is preferred. This preferred substrate is fiberglass insulation batting. Fiberglass insulation batting may be referred to as spun fiberglass insulation batting. FIG. 4D shows fiberglass insulation batting 31 that has been cut by the apparatus of FIG. 1. This cut is indicated by line 186. Fiberglass insulation batting is resilient, i.e., after compression it returns to its original form. Substrate 31 includes a fiber portion 188, preferably a fiberglass portion. Fiber portion 188 may be a plastic fiber. Fiber portion 188 may be a plastic fiber where the plastic fiber is manufactured from recycled plastic. Substrate 31 may be a rock or slag wool batting. Substrate 31 may be a foam or a rigid foam or an extruded polystyrene foam. Substrate 31 may or may not include a facing 190 running the length and width of the fiber portion 188 on one of the faces of the fiber portion 188. Facing 190 may be a paper facing, or a paper facing with a thin layer of asphalt, or a foil facing. Facing may be a vapor retarder, such as paper facing, or a vapor barrier, such as a foil facing. Facing 190 may or may not be cut by the junction between the cutting edge 100 and rolling anvil 16. If substrate 31 includes facing, the substrate 31 is fed with the facing down on the feed table 76. Toggle clamp 54 may be adjusted so as to regulate whether or not facing 190 is to be cut. In other words, toggle clamp 54 may be adjusted to selectively cut the fiber portion 188 and leave intact the facing 190. Such a selective cut may be advantageous because, when installed, the uncut facing 190 may be engaged over a stud and employed as a vapor barrier. Substrate 31 may be in a range between one-hundredths of an inch and about 24 inches wide. Substrate 31 may be in a range between one-hundredths of an inch and about 12 inches thick (deep). Vaulted ceilings require fiberglass insulation batting about 12 inches thick.

Figure 8:
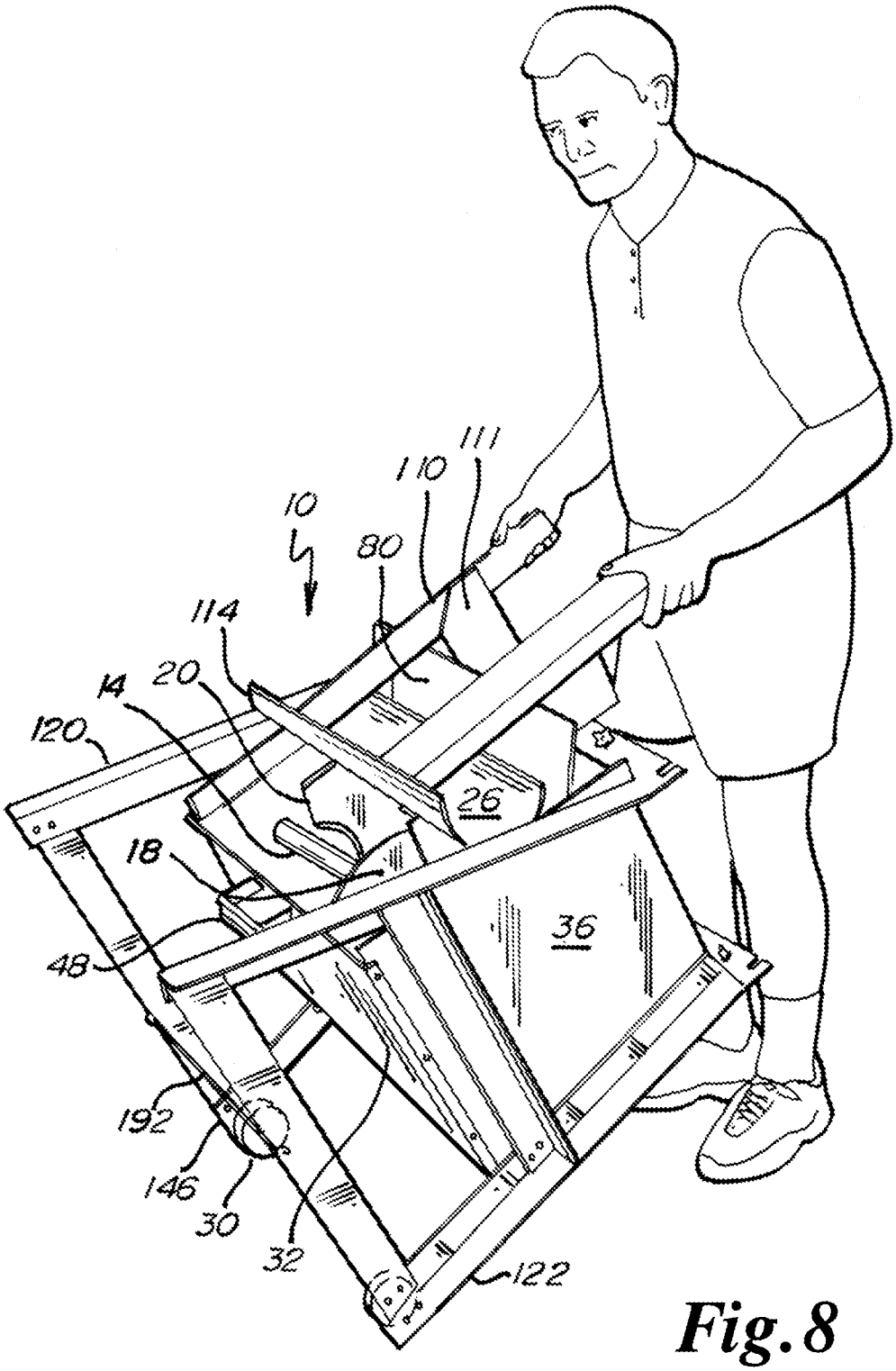
FIG. 8 is a perspective view of the rotary cutting apparatus of FIG. 1 in a wheelable and compact configuration where the apparatus may be wheeled about in the nature of a wheelbarrow.

FIGS. 6A to 6G show one way to transform the apparatus in its upright and operating configuration of FIG. 1 into the compact, transportable and wheelbarrow configuration of FIG. 8. First, a user may walk to the rear of the apparatus 10 in its upright and operating configuration of FIG. 6A. Then, as shown in FIG. 6B, a user may tilt the apparatus 10 so as to bring wheels 60 into engagement with the plane of the floor or environmental surface such as a driveway or ground and to displace the distal ends of the four legs 118, 120, 122, 124 from the plane of the environmental surface. Then, as shown in FIG. 6C, the apparatus 10 is laid down on the environmental surface with the housing 12 such that the top 32 runs transversely to the environmental surface. Then, as shown in FIG. 6D, the tipping action continues such that the top 32 is laid down on the environmental surface such that the top 32 confronts the environmental surface. At this point, it should be noted that FIGS. 6D and 6E show the apparatus 10 in the same position; FIG. 6D is a side view and FIG. 6E is a rear view. Then, as shown in FIG. 6F, clamps of clamp pins 132 are screwed out to loosen the connection between extension 128 and lateral angle iron support 112, and legs 118, 120, 122 and 124 are swung out such that the distal ends make contact with the ground or environmental surface. Then the body of the legs 118, 120, 122 and 124 are swung in to confront the housing 12 and, at the same time, the housing 12 is lifted, such as by utilizing handle 74. Then a flexible element 192 such as a cord or bungee cord may be utilized to engage rear legs 122, 124 as shown in FIG. 6G, or the flexible element 192 may engage the braces 136, 138 as shown in FIG. 8. FIG. 6G and FIG. 7 show the apparatus 10 in the same position. In such a position, apparatus 10 is sufficiently compact so as to be stored or lifted or placed in the trunk of a car, or in the back of a van, or in the back of a station wagon, or in the back of an sport utility vehicle. From the state shown in FIG. 6G or FIG. 7, apparatus 10 is tipped back on the wheels 10, and the user grabs the proximal ends of the arms 110 so as to wheel apparatus 10 about in the nature of a wheelbarrow as is shown in FIG. 8.

FIG. 7 shows a compact configuration of the rotary cutting apparatus 10. Relative to FIG. 1, height is reduced by the height of the housing 12. In the upside down configuration of FIG. 7, features or mechanisms in the housing 12 remain intact and no greater stress is placed on any of the features or mechanisms.

FIG. 8 shows the wheelable or wheelbarrow configuration. Here the inner ends of the arms 110 double as handles. When arms 110 are swung to such a handle position, edges of the arms 110 ride against the outer edge of the ramp 80. As in the tilted position of FIG. 6B, feet 146, extending transversely relative to legs 122, 124, work as legs such that wheels 30 engage the ground instead of the distal ends of the legs 122, 124.

In operation, prior to feeding substrate 31 into inlet 22, lower roller 16 is dropped down via the over center toggle clamps 54. Then blade 100 is slid laterally via pressure placed on hub 102 to set the width of the cut to be made in substrate 31. Then the lower roller 16 is lifted up via the over center toggle clamps 54 such that cutting edge 100 impinges on the resilient covering 108. Then, or prior to the lower roller 16 being lifted up by the over center toggle clamps 54, a fine adjustment is made to the altitude of the upper surface of lower roller 16 (or to the altitude of the axis of the lower second roller 16) by microadjustment mechanism or first nut 184 on the over center toggle clamps 54 such that the desired impingement of cutting edge 100 upon resilient covering 108 is made. Then fence 20 is slid via hand pressure so as to set the distance between fence 20 and the main body or main panel 68 of wall 36 for the particular width of the substrate 31. Then a section of substrate 31 is laid on top of feed transitional member 26, is laid on top of ramp portion 80, is fed manually into the inlet 22 using the hand tool 104, is fed manually into the junction between the cutting edge 100 and the rolling anvil 16 using the hand tool 194, and continues to be fed. This feeding action compresses, pinches and cuts the substrate 31 between the cutting edge 100 and the rolling anvil 16 and, in response, the blade 18 and rolling anvil 16 begin to rotate. Blade 18 rotates in one direction and rolling anvil 16, which is driven by the impingement of blade 18, rotates in the opposite direction. After the proximal end of the section of substrate 31 exits the junction between the cutting edge 100 and the rolling anvil 16, and after such proximal end is of a sufficient length to be safely grabbed, the operator of the apparatus walks to the rear of apparatus 10 and grabs one or both (now cut) ends of the proximal end section of the substrate 31. Then the operator pulls in the longitudinal direction on one or both of the cut proximal ends of the substrate 31, an action that continues to pinch the substrate 31 at the junction of the cutting edge 100 and rolling anvil 16, which pinching action continues to drive the rotary blade 18 such that no motor or hand cranking of the blade 18 is required.

Fiberglass insulation batting is difficult to cut with a hand tool because it is difficult to compress such batting with a hand tool. Present apparatus 10 compresses, pinches, and cuts.

An advantage of the present apparatus 10 is that it cuts square. A hand tool may not cut square. Further, from the nature of the cutting using the present apparatus 10, the two sections of cut substrate 31 (preferably fiberglass insulation batting) tend to re-engage each other after being cut such that the user may maintain one pile of substrate 31 prior to the cut and one pile of substrate 31 after being cut.

The hand tool 104 of the present apparatus 10 provides 1) a safety function, 2) a pushing function, and 3) a preliminary compression function. When the user walks to the rear of the apparatus 10 and begins to pull the substrate 31 through the junction of the cutting edge 100 and rolling anvil 16, the cutting edge 100 and rolling anvil 16 take over the compression function.

Apparatus 10 provides a fine cut with compression without destroying the integrity or resilience of the substrate 31, such as the fiberglass insulation batting. Substrate 31 provides the same loft (and insulation qualities) prior to and after being cut by the apparatus 10.

Apparatus 10 provides a faster cut of substrate 31 than does a cut with a hand tool.

The rear edge of top 32 terminates short of the rear edges of sides 34, 36. However, if desired, the rear edge of top 32 can terminate in or at about the same plane as where rear edges of sides 34, 36 terminate.

The flanges or the obliquely extending edges of the inlet 22 and outlet 24 minimize a catching of the substrate 31 as the substrate 31 is fed into the inlet 22 and drawn out of the outlet 24.

Apparatus 10 is relatively lightweight. Apparatus 10 can be carried by an adult mail of average size, where handle 74 is used for lifting and where the apparatus 10 is in the configuration shown in FIG. 7. Even though apparatus 10 is of relatively lightweight, apparatus 10 maintains its footing on a concrete surface without sliding or slipping when substrate 31, such as fiberglass insulation batting, is grabbed and pulled through the junction between cutting edge 100 and rolling anvil 16.

Apparatus 10 may be used to score without cutting a substrate 10. For example, the toggle clamps 54 on each ends of the rolling anvil 16 may be adjusted to space the circumference of the rolling anvil 16 from the cutting edge 100 such that a vertical space is present between circumference of the rolling anvil 16 and the cutting edge 100, with the substrate 31 to be scored having a vertical height greater than such vertical space.

Apparatus 10 alleviates itching where substrate 31 is fiberglass insulation batting, and apparatus 10 minimizes the contact that the user has with substrate 31. For example, a user may grab only once the two sections of the substrate 31 that is first cut, and then walk in the longitudinal direction away from apparatus 10 until the entire length of the substrate 31 is cut.

Apparatus 10 can cut to a width in the range of between about one inch and about 23 inches. Even such a one inch narrow cut provides a one inch strip of substrate 31 that has two parallel sides, where one side is a side cut by apparatus 10, such that the cut side is square and true.

Apparatus 10 is an easy apparatus for the unskilled worker to learn to use, especially where the substrate 31 is fiberglass insulation batting. In contrast, the learning curve for hand tools that cut fiberglass insulation batting is difficult and slow.

Housing 12, top 32, side 34, side 36, bottom 38, legs 118, 120, 122, 124, braces 138, 140, 142, 144, fence 20, feed transition member 26, handles 48, 74, hand tool 104, horizontal arms 110, angle iron supports 111, angle iron lateral supports 112, and other like elements of apparatus 10 may be formed of a sheet metal, galvanized sheet metal, plastic, or be plastic molded.

Figure 3:
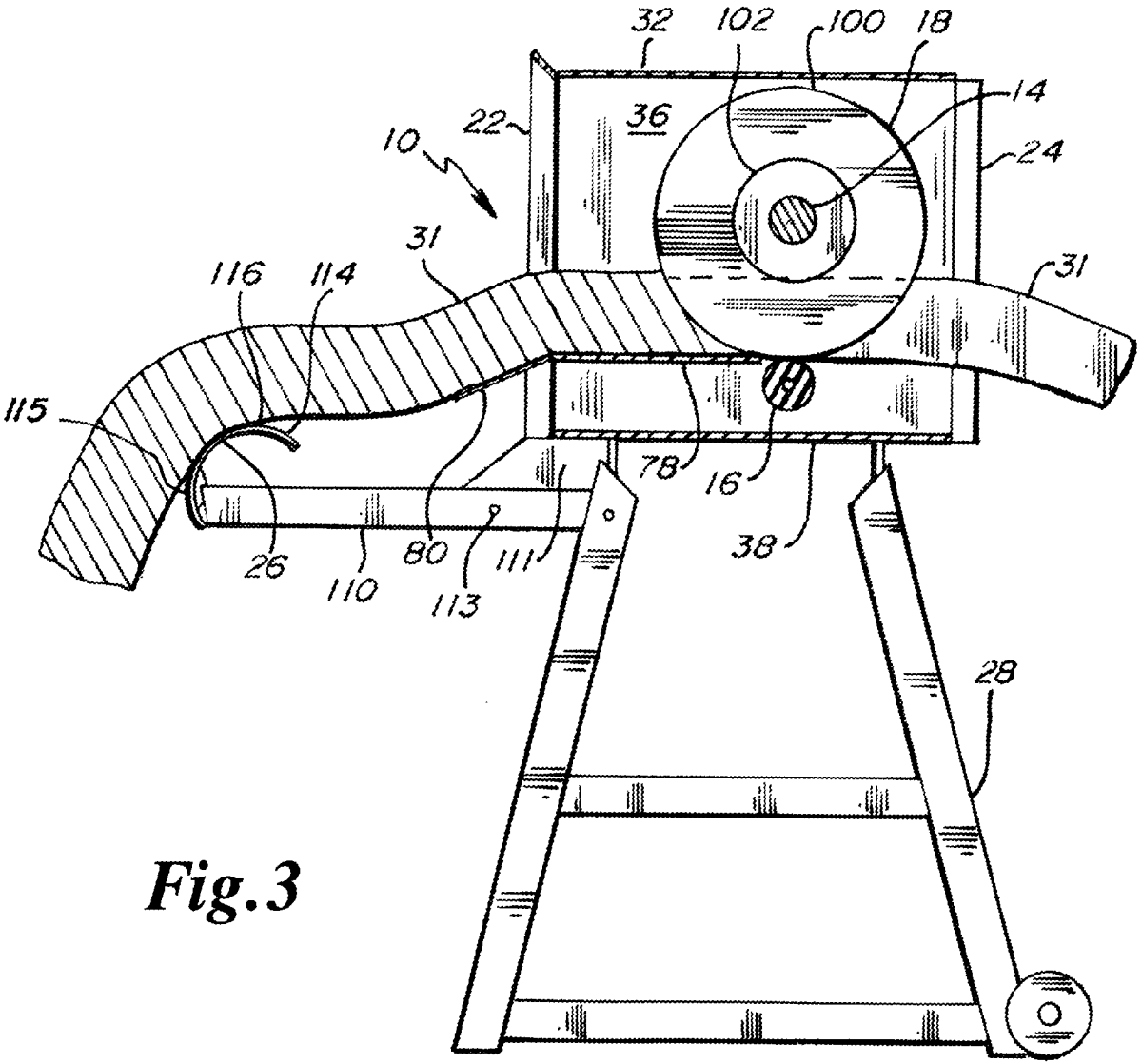
FIG. 3 is a side partially section view of the rotary apparatus of FIG. 1 and shows the rotary blade and rolling anvil pinching the substrate.

As shown in FIG. 3, the circular cutting edge 100 extends for 360 degrees about the rotary blade 18.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A manual push in and manual pull out substrate driven rotary cutting apparatus for cutting a fiberglass insulation batting substrate, comprising:

a) a housing having an inlet and outlet, the fiberglass insulation batting substrate being pushed into the inlet manually, the fiberglass insulation batting substrate being pulled out of the outlet manually;

b) a rotary blade mounted in the housing between the inlet and outlet, said rotary blade having a circular cutting edge, the rotary blade turning on a first axis, the circular cutting edge extending for 360 degrees about the rotary blade;

c) an anvil in the housing, the circular cutting edge of said rotary blade confronting said anvil at a location on said anvil, said fiberglass insulation batting substrate being fed into said location to cut said fiberglass insulation batting substrate, and said fiberglass insulation batting substrate being fed into said location to pinch said fiberglass insulation batting substrate between said circular cutting edge and said anvil to thereby drive said rotary blade when said fiberglass insulation batting substrate is pulled out of the outlet manually;

d) wherein said rotary blade is mounted on a first roller, the first roller being rotatable on an axle that is engaged to the housing, said rotary blade being rotatable relative to said first roller which in turn is rotatable relative to said axle, said first roller and axle having said first axis, the first roller having an axial direction;

e) wherein said anvil comprises an anvil roller comprising a resilient external surface that is confronted by said circular cutting edge of said rotary blade, said anvil roller turning on a second axis and being driven by the rotary blade when fiberglass insulation batting substrate is fed into said location, said first and second axis being parallel, the anvil roller having an axial direction, the fiberglass insulation batting substrate being fed between the first roller and anvil roller;

f) wherein the rotary blade is slideably mounted on said first roller such that the rotary blade slides laterally on said first roller to laterally slide the circular cutting edge to cut the fiberglass insulation batting substrate to different widths, wherein the rotary blade is slideably mounted on said first roller such that the rotary blade slides under hand pressure laterally relative to said first roller;

g) wherein said resilient external surface extends laterally to confront the circular cutting edge as the circular cutting edge slides laterally, said circular cutting edge engaging said resilient external surface at said location;

h) wherein said rotary blade includes a first resistance to rotation relative to the first roller, wherein said first roller has a second resistance to rotation relative to said axle, with the first resistance to rotation being greater than the second resistance to rotation such that said rotary blade normally rotates with said first roller;

i) wherein said rotary blade rotates in one direction and wherein said anvil roller rotates in the opposite direction when said fiberglass insulation batting substrate is fed into said location;

j) wherein said rotary blade defines a plane, and wherein said rotary blade and anvil roller are adjustable to and away from each other in said plane to permit said rotary blade to slide laterally on said first roller; and k) wherein the apparatus is free of an electric power source or fuel powered power source for driving said rotary blade.

* * * * *